United States Patent [19]

Yoshida et al.

[11] Patent Number: 4,909,329

[45] Date of Patent: Mar. 20, 1990

[54] FIRE SUPERVISING SYSTEM AND EXTINGUISHING TARGET DETERMINING SYSTEM

[75] Inventors: Yoshiyuki Yoshida; Kazutaka Onozuka, both of Tokyo; Yoshihiko Ohashi, Fujisawa; Toshihide Tsuji; Kensuke Miyazaki, both of Sagamihara, all of Japan

[73] Assignees: Kabushiki Kaisha Kockiki Corp., Tokyo; Takenaka Komuten Co. Ltd., Osaka, both of Japan

[21] Appl. No.: 88,673

[22] Filed: Aug. 24, 1987

[30] Foreign Application Priority Data

Aug. 27, 1986 [JP] Japan ..... 61-201164

[51] Int. Cl.[4] ..... A62C 37/18

[52] U.S. Cl. ..... 169/61; 169/25; 239/69

[58] Field of Search ..... 169/15, 16, 17, 25, 169/60, 61, 47; 239/69, 210, 587

[56] References Cited

U.S. PATENT DOCUMENTS

| | | | |
|---|---|---|---|
| 2,834,416 | 5/1958 | Becker | 169/25 |
| 3,588,893 | 10/1968 | McCloskey | 169/61 |
| 3,762,478 | 10/1973 | Cummins | 169/25 |
| 4,015,366 | 4/1977 | Hall | 239/210 |
| 4,082,148 | 4/1978 | Willms | 169/61 |
| 4,091,874 | 5/1978 | Monma | 169/61 |
| 4,178,994 | 12/1979 | Ito et al. | 169/61 |
| 4,181,179 | 1/1980 | Batte | 169/61 |
| 4,597,451 | 7/1986 | Moore et al. | 169/61 |
| 4,609,048 | 9/1986 | Yasaki et al. | 169/61 |
| 4,671,362 | 6/1987 | Odashima | 169/61 |

*Primary Examiner*—Sherman D. Basinger
*Assistant Examiner*—Thomas J. Brahan
*Attorney, Agent, or Firm*—Lackenbach Siegel Marzullo & Aronson

[57] ABSTRACT

This invention relates to a fire supervising system and a fire extinguishing target determining method in the water discharging and fire extinguishing operation. The system and method of the present invention is characterized by dividing a fire supervisory region into a matrix pattern to set a pluraity of sections; identifying the section corresponding to a position of a fire from the positional information of the fire starting within the supervisory region which has been output from a fire sensor; and selecting a water discharging target for a water discharging nozzle based on a priority order which has been preliminarily set for the respective sections or selecting the water discharging nozzle in charge, optimum for the fire extinguishing operation which has been set preliminarily for the respective sections.

15 Claims, 7 Drawing Sheets

| | |
|---|---|
| ADDRESS NUMBER Mi | PRIORITY ORDER |
| WATER DISCHARGING NOZZLE SELECTION | HORIZONTAL REACH SETTING |

FIRE SUPERVISING SYSTEM AND EXTINGUISHING TARGET DETERMINING SYSTEM

BACKGROUND OF THE INVENTION

This invention relates to a fire patrolling or supervising system which is suitable especially for a wide area such as a colossal structure, for example, a large-scale pavilion, an air-dome stadium, etc.

This invention further relates to a method for controlling the selection or assignment of a water discharging nozzle and selection of a fire extinguishing target.

In a fire extinguishing system including a water discharging nozzle which is installed in a structure having a wide supervisory region, such as a stadium or pavilion, there has been known a system in which a position of a fire is detected by a fire sensor when the sensor scanning the supervisory region has detected the fire and the water discharging nozzle is actuated to discharge water in response to the detection data. For example, there is a technique in which a fire position co-ordinate (x, y) in a two-dimensional co-ordinate, in which a positional information output from the fire sensor is viewed planely, is calculated and a distance between the fire and the water discharging nozzle is calculated on the basis of the fire position co-ordinate (x, y). This technique is know from Japanese Jitsuyo Kokai Gazette No. 61-78395 (based on this Japanese application, U.S. application Ser. No. 854,932 was filed on Apr. 23, 1986, U.K. application No. 8610166 was filed on Apr. 25, 1986, West German application was filed on Apr. 26, 1986 and Australian application was filed on Apr. 22, 1986).

However, in case a single water discharging nozzle is assigned for one fire sensor on the one-to-one basis, even if the entire supervisory region can be patrolled by one fire sensor, a dead space where water discharged from the water discharging nozzle can not reach may remain because the supervisory region may too large for the assigned nozzle. A plurality of water discharging nozzles must be provided to enable extinguishment for whole area of the supervisory region. However, there still remains a problem of determining which discharge nozzle should be selected to surely extinguish the fire after detection of the fire by the fire sensor. In this connection, it is to be noted that it needs complex calculation for selecting the optimum water discharging nozzle for the position of fire based of the fire position information. Namely if the following calculation may be used to determine the optimum water discharging nozzle:

1. calculate the distances of the fire from the water discharging nozzles, respectively,
2. select a optimum water discharging nozzle to extinguish the fire based on the result of the above calculation (1) and reaches of nozzles, and if two or more nozzles may come under the condition to be selected as the optimum nozzle for extinguishing a fire, it would be a very complex determination to select a more optimum nozzle.

Moreover, in the conventional technique, when a plurality of fires start within the supervisory region simultaneously, the sizes of the detected fires are compared with each other to determine the priority order of extinguishing, or the degree of danger is judged by a lookout for selecting a fire extinguishing target, considering the possibility of fire spread. Thus, there are such problems that it takes a time to calculate the sizes of the fires and the judgment by the lookout might possibly be inadequate to wrongly select an extinguishing target of less danger.

The present invention has been made with a view to obviating such problem involved in the conventional techniques, and it is an object of the present invention to provide fire supervising system and a fire extinguishing target determining method, which is capable of selecting a water discharging nozzle directly from a fire position information without calculating a distance between the fire position and the water discharging nozzle, and capable of automatically selecting a fire, as a fire extinguishing target, which has the highest priority level, when a plurality of fires start at different places within the supervisory region.

To achieve this object, the present invention features a fire supervising system which comprises: at least one fire sensor for detecting a fire starting within a supervisory region to output a positional information of the detected fire; one or more water discharging nozzles for discharging water into the supervisory region; a section setting means for dividing the supervisory region into a matrix pattern to set a plurality of sections; a section identifying means which is input with the fire position information from the fire sensor to identify the section corresponding to said position information; and a nozzle control means for selecting a water discharging target to drive the water discharging nozzle on the basis of an output from the section identifying means and a priority order of the sections which is set preliminarily.

The present invention further features a fire supervising system which comprises: at least one fire sensor for detecting a fire starting within a supervisory region to output a positional information of the detected fire; a plurality of water discharging nozzles for discharging water into the supervisory region; a section setting means for dividing the supervisory region into a matrix pattern to set a plurality of sections; a section identifying means which is input with the fire position information from the fire sensor to identify the section corresponding to said position information; and a nozzle control means for selecting one of the water discharging nozzles in charge, which are assigned for the respective sections, in response to an output from said section identifying means.

The present invention further features a method for determining a fire extinguishing target which comprises dividing a fire supervisory region into a matrix pattern to set a plurality of sections; identifying the section corresponding to a position of a fire from the positional information of the fire starting within the supervisory region which has been output from a fire sensor; and selecting a water discharging target for a water discharging nozzle based on a priority order which has been preliminarily set for the respective sections.

The present inventions as described above are implemented with the support of a computer and the setting of the sections, identification of the setting and the control of the nozzle or nozzles are attained by utilizing various functions of the computer, such as storing, controlling or calculating.

More specifically, the present invention can curtail a time necessary for the processing for nozzle selection and determine definitely the priority order of each of fires as a fire extinguishing target upon identification of the section number when a plurality fires start at different places within the supervisory region. Therefore, the position of the fire which is to be the first fire extinguishing target can be determined rapidly and accurately. Furthermore, the optimum one of the plural water distinguishing nozzles can be selected to start an appropriate fire extinguishing operation. Thus, a time otherwise wasted between the fire detection and the water discharge starting would be saved very much to improve a fire extinguishing operation at an early state.

DESCRIPTION OF PREFERRED EMBODIMENT

A preferred embodiment of the present invention will now be described.

Figure 1:
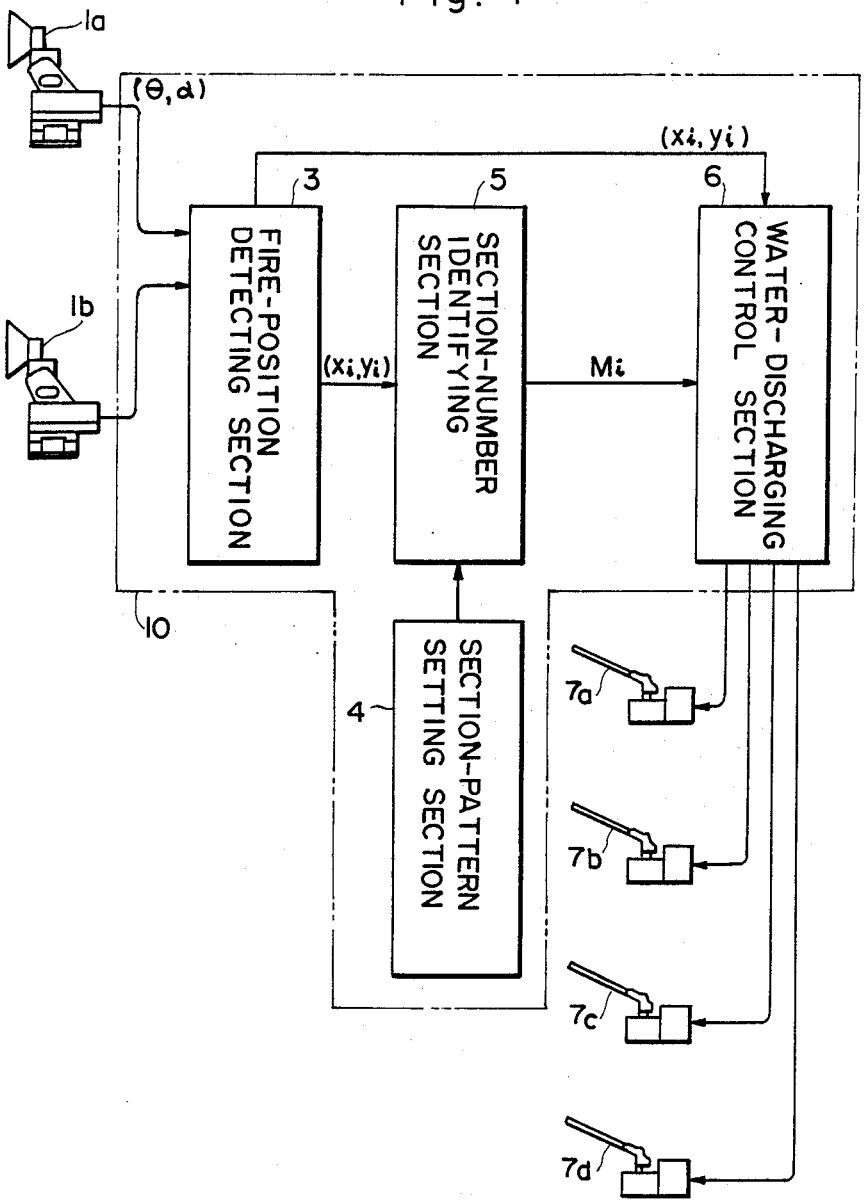
FIG. 1 is a block diagram showing schematically an embodiment of the present invention.

A fire supervising system of the present invention comprises two fire sensors 1*a*, 1*b*, a calculating unit 10 and four water-discharging nozzles 7*a* to 7*d* as shown in FIG. 1.

Figure 2:
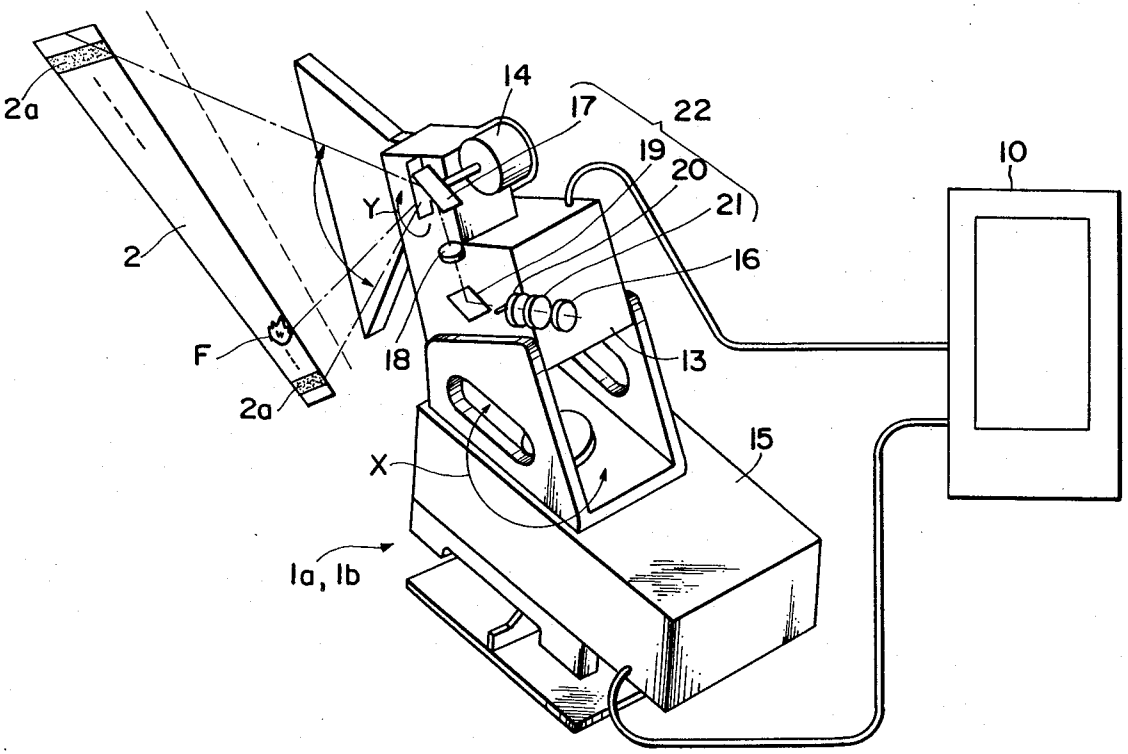
FIG. 2 is a diagrammatical perspective view of a configuration of a fire sensor.

The fire sensors 1*a*, 1*b* each have a detecting head 13 and a vertical scanning drive means comprising a motor 14, which are mounted on a horizontal scanning drive means comprising a rotator 15 as shown in FIG. 2. The fire sensors 1*a*, 1*b* are installed at positions where they can see a supervisory region, such as a stadium, entirely.

Figure 3:
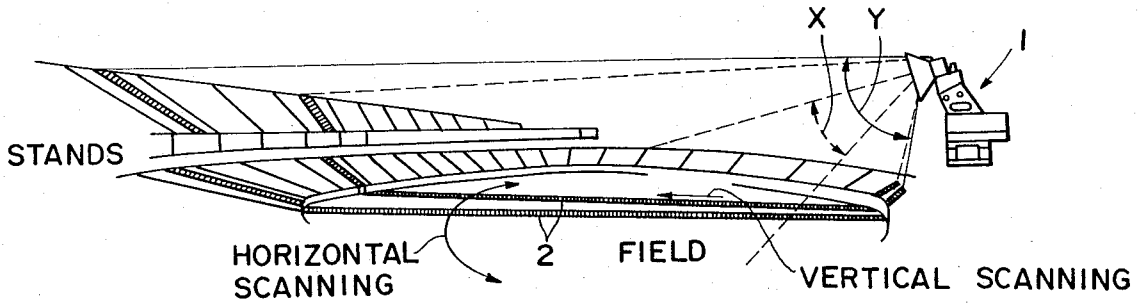
FIG. 3 is a perspective view showing a stadium to be supervised and a supervising scanning operation for the same by the fire sensor.

The detecting head 13 comprises a detecting device 16 and an optical system 22 including a rotary mirror 17, an objective lens 18, a reflector 19, a slit 20 and a condensing lens 21. As examples of the detecting device 16, there may be mentioned a thermoelctromotive force element such as a pyroelectric element, a photoelectric tube, a photomultiplier, etc. a photoconductive element such as PbS, PbSe, InSb, HgCdTe, etc. or a solid image pick up element such as CCD. The optical system 22 is not critical in the present embodiment and any conventional device or system which optically condenses beams may be employed. The slit 20 of the optical system 22 defines an instantaneous or momentary view field 2*a* functioning as a detector. The slit 20 is a stop or aperture for the condensing lens 21. Thus a corresponding supervisory region in the supervisory area to the instantaneous view field 2*a* is narrow and the detection range 2, which consist of a plurality of such the instantaneous view fields, is of an elongated strip as shown in FIG. 3. The rotary mirror 17 rotates in the vertical direction (in a direction as shown by arrow Y) at a predetermined speed, according to the rotation of the motor 14, to scan the detecting range 2 vertically. The rotator 15 rotates reciprocatingly in the horizontal direction (in a direction as shown by arrow X), while carrying the detecting head 13 and the motor 14, for driving the detecting head 13 to scan the supervisory region.

More particularly, the region to be subjected to the horizontal scanning is divided into a plurality of steps. One vertical scanning operation is carried out by the rotation of the rotary mirror 17 upon every movement of one horizontal scanning step. These horizontal and vertical step scanning operations are repeated to scan the entire supervisory region.

The fire sensor employable in the present embodiment is not limited to that as shown in FIG. 2, but it may have a detecting head which may rotate both in the horizontal and the vertical direction for carrying out the scanning in the directions. The fire sensor is not limited to a scanning type, either. For example, a plurality of separate photoelectric fire sensors, which comprises a light emitting section and a light receiving section, may be employed so that a matrix supervision pattern may be obtained. Thus, any type of fire sensors which can detect a fire position may be employed.

In the present embodiment, only one of the two fire sensors 1*a*, 1*b*, namely the fire sensor 1*a*, is normally in operation. Only when the fire sensor 1*a* has detected a fire, another fire sensor 1*b* which is normally out of operation is actuated so that, for example, the first sensors are operated alternatively upon every horizontal scanning for detecting a fire. When the fire sensor 1*a*, which is normally in operation, detects a fire F, a fire position information comprising a horizontal scanning angle $\theta$ and a vertical scanning angle which correspond to the fire starting position is output to the calculating unit 10.

The calculating unit 10 comprises a fire position detecting section 3, a section-pattern setting section 4, a section-number identifying section 5 and a water discharging nozzle control section 6.

Figure 4:
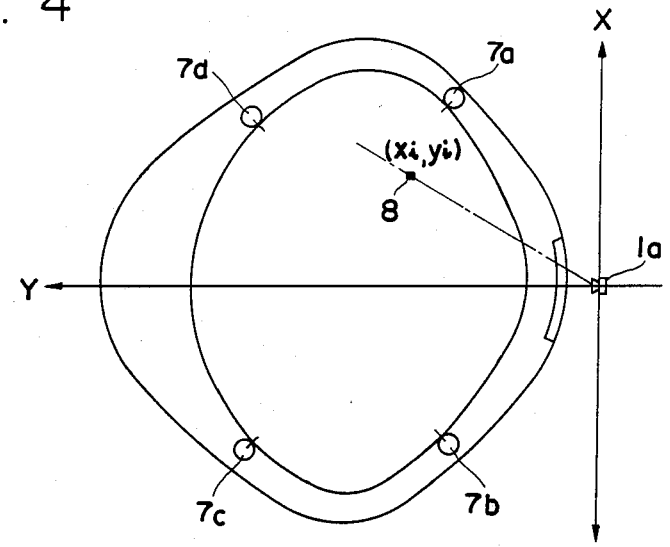
FIG. 4 is a plan view showing the setting of a fire position co-ordinate in relation with one fire sensor.

A detection signal of the detecting device 16 which comprises a detection signal indicative of a vertical scanning angle $\alpha$ of the rotary mirror 17 and a detection signal indicative of a horizontal rotational angle $\theta$ of the rotator 15 is input to the fire position detecting section 3. The fire position detecting section carries out the calculation processing for every instantaneous view field 2*a*, so that a positional signal ($\theta$, $\alpha$) of the fire F which is given from the fire sensors 1*a*, 1*b*, in terms of the scanning angles, is converted into a positional co-ordinate (x, y) of an XY co-ordinate when the supervisory region is viewed planely. The positional co-ordinate (x1, y1) of the fire F is set, for example, as a two-dimensional co-ordinate with the installation position of the fire sensor 1*a* used as an origin point as shown in FIG. 4.

The fire position detecting section 3 is preliminarily given a reference value for making a determination of a fire and the section 3 compares a measured detection value for each of the co-ordinate positions with the reference value so that it makes a fire determination when the measured value exceeds the reference value. The reference value for fire determination is smaller as the position is more remote from the fire sensors 1*a*, 1*b*. In other words, the sensitivity of the sensors are increased as the position is farther from the sensors so that fire detection of a predetermined accuracy may be assured irrespective of the distances from the fire sensors 1*a*, 1*b*.

Figure 5:
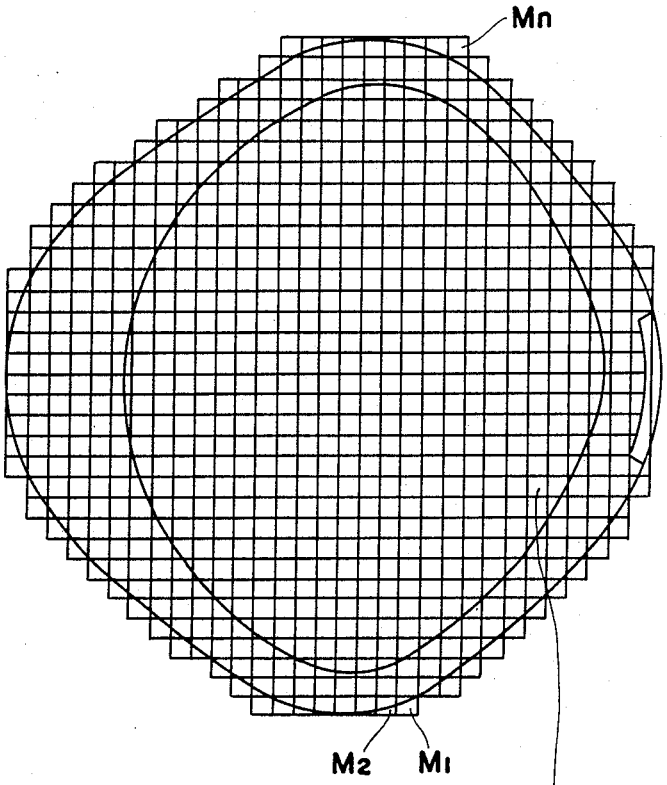
FIG. 5 is a plan view of the supervisory region in which a plurality of sections are hypothetically set in a matrix pattern.

The section-pattern setting section 4 has a plurality of sections into which the entire supervisory region has been preliminarily divided in a rectangular matrix pattern as shown in FIG. 5 and stores section numbers M1, M2 . . . Mn allotted for the respective sections. In FIG. 5, about 800 sections are shown and a side of each of the sections has a length of about 5 m in a general ballpark or stadium. Further each of sections may be the same space as the space of the instantaneous view field *2a* or more.

Referring again to FIG. 1, the section-number identifying section 5 is input with a positional co-ordinate (x, y) indicative of the position of the fire calculated by the fire position detecting section 3 and a section pattern set at the section-pattern setting section 4 to identify the section where the fire position co-ordinate (x, y) is included and output the number of the so identified section.

The water discharging nozzle control section 6 stores the section numbers M1, M2 . . . Mn of the respective sections as address data as hypothetically shown in FIG. 5. In addition, the water discharging nozzle control section 6 further stores water discharging nozzle selecting data for selecting any one of plural water discharging nozzles, four water discharging nozzles in this embodiment, which are installed in the supervisory region, for each of the addresses, priority order data for selecting a fire extinguishing target when a plurality of fires has started at different places, and horizontal reach setting data for the water discharging nozzles to be selected.

More specifically, the four water discharging nozzles *7a*, *7b*, *7c* and *7d* are disposed at four positions as illustrated in FIG. 4 in the present embodiment and the sections, which are allotted to the water discharging nozzles as extinguishing targets thereof, respectively, are preliminarily set according to the installation positions of the water discharging nozzles *7a* to *7d*. In each of data areas of the addresses having the section numbers M1 to Mn of the water discharging nozzle control section 6, the selection information for selecting one of the water discharging nozzles *7a* to *7d* which includes the section as a fire extinguishing target has been preliminarily stored.

The priority order data of the fire extinguishing targets stored in the data areas of the water discharging nozzle control section 6, while corresponding to the section numbers M1 to Mn, is a priority information about the priority order for fire extinguishing operation which is determined, considering the positions of exit accesses, positions including sections where a fire is easy to spread. Of course, all the data about priority levels of the respective sections M1 to Mn are stored in the data areas of the water discharging nozzles for attaining the preferential selection of the fire extinguishing target.

Referring again to FIG. 1, the four water discharging nozzles *7a* to *7d* are connected to the water discharging nozzle control section 6 and they are subjected to the selection and control of the water discharging nozzle and the preferential selection and control of the fire extinguishing target by the water discharging nozzle control section 6 based on the section number Mi identified by the section-number identifying section 5.

The water discharging nozzles *7a* to *7d* are rotatable only in the horizontal direction and they are fixed, in the vertically direction, at an angle of elevation which provides a maximum horizontal reach. Therefore, the control of the horizontal reach determined by the fire position is attained as follows: the relationship between a horizontal reach and a water discharging pressure is preliminarily obtained by experiments; this relationship is utilized to control the opening of the electrically operated valve which is provided in a water supply piping; and the horizontal reach is set freely as desired within a predetermined range, for example, within a range of 15 to 90 m through the resultant water pressure control. The horizontal reaches setting data for the water discharging nozzles *7a* to *7d* based on the opening control of the electrically driven valve are preliminarily stored in the data areas of the water discharging nozzle control section 6 for the respective sections.

The configuration of the water discharging nozzle 7 will now be described, while referring to FIG. 6. The water discharging nozzle 7 is mounted on a turret through a horizontal rotary member 23 so as to be rotatable in the horizontal direction. The angle 100 of elevation is fixed at an angel where the maximum horizontal reach can be obtained as described above. The angle 100 of elevation which provides the maximum horizontal reach to the water discharging nozzle 7 is preferably selected to be around 25° according to the results of experiments conducted by the inventors. The water discharging nozzle 7 is connected to a water supply piping 24 leading to an extinguishing pump (not shown).

An electrically driven valve 25 is provided at an intermediate position between the ends of the water supply piping 24 from the extinguishing pump, which is connected to the water discharging nozzle 7. The electrically driven valve 25 effects the opening control of the valve by a motor built therein and it is generally used for control of a flow rate. A pressure sensor 26 is provided on a secondary side of the electrically driven valve 25 to detect the water discharging pressure.

The water discharging nozzle 7 of the present embodiment has such a configuration in which compressed air is blown into around the water stream passing through the nozzle so as to ensure a long horizontal reach and a wide water distribution area at a low pressure and with a small water discharging amount. For this purpose, an air piping 24a is connected. Such a water discharging nozzle which utilizes compressed air is disclosed in Japanese Jitsuyo Kokai Gazette No. 62-64566.

To such a piping system for the water discharging nozzle 7, a horizontal reach control means is provided, which comprises a pressure setter 29, an adder 30 and a current amplifier 32.

The pressure setter 29 is input with a set horizontal reach from the water discharging nozzle control section 6 and outputs a water discharging pressure Pi corresponding to the set horizontal reach, to the adder 30, as a control target valve. The pressure setter 29 has a function of converting the horizontal reach S into the water discharging pressure P. This conversion characteristic is determined according to the relationship between the water discharging pressure and the horizontal reach on the basis of the results of the experiments conducted in connection with the water discharging nozzle 7.

As the adder 30 has been input with the water discharging pressure P detected by the pressure sensor 26 when it receives the set pressure Pi from the pressure setter 29, the adder 30 outputs a deviation Δ P between the set pressure Pi and the water discharging pressure P to the current amplifier 32. The current amplifier 32 outputs a current signal corresponding to the pressure deviation Δ P from the adder 30 to the electrically driven valve 25. For example, when a control current for the electrically driven valve 25 is 4 to 20 mA, the deviation Δ P detected by the pressure sensor 26 is also converted into a current signal of 4 to 20 mA. The electrically driven valve 25 changes the opening of the valve by the motor in response to the current signal from the current amplifier 32. The opening of the electrically driven valve 25 is controlled by a feedback system comprising the pressure setter 19, the adder 30, the current amplifier 32, the electrically driven valve 25 and the pressure sensor 26 and a feedback system comprising the electrically driven valve 25 and the pressure sensor 26, so that the water discharging pressure of the water discharging nozzle 7 may be the set pressure Pi set by the pressure setter 29.

Figure 7:
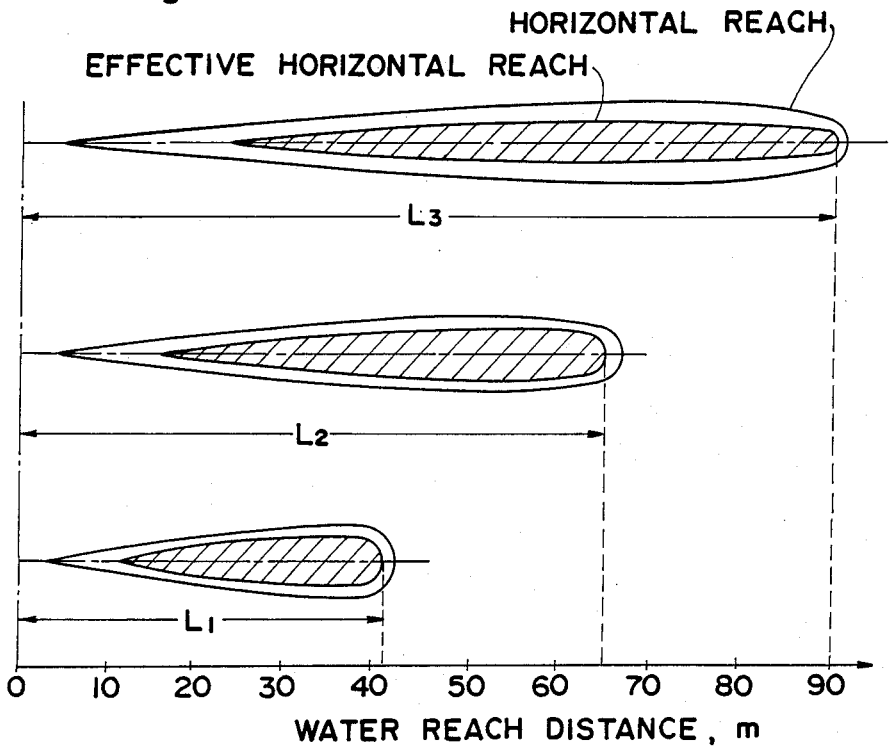
FIG. 7 is a graph showing the relationships between the horizontal reaches and the water discharging patterns.
Figure 6:
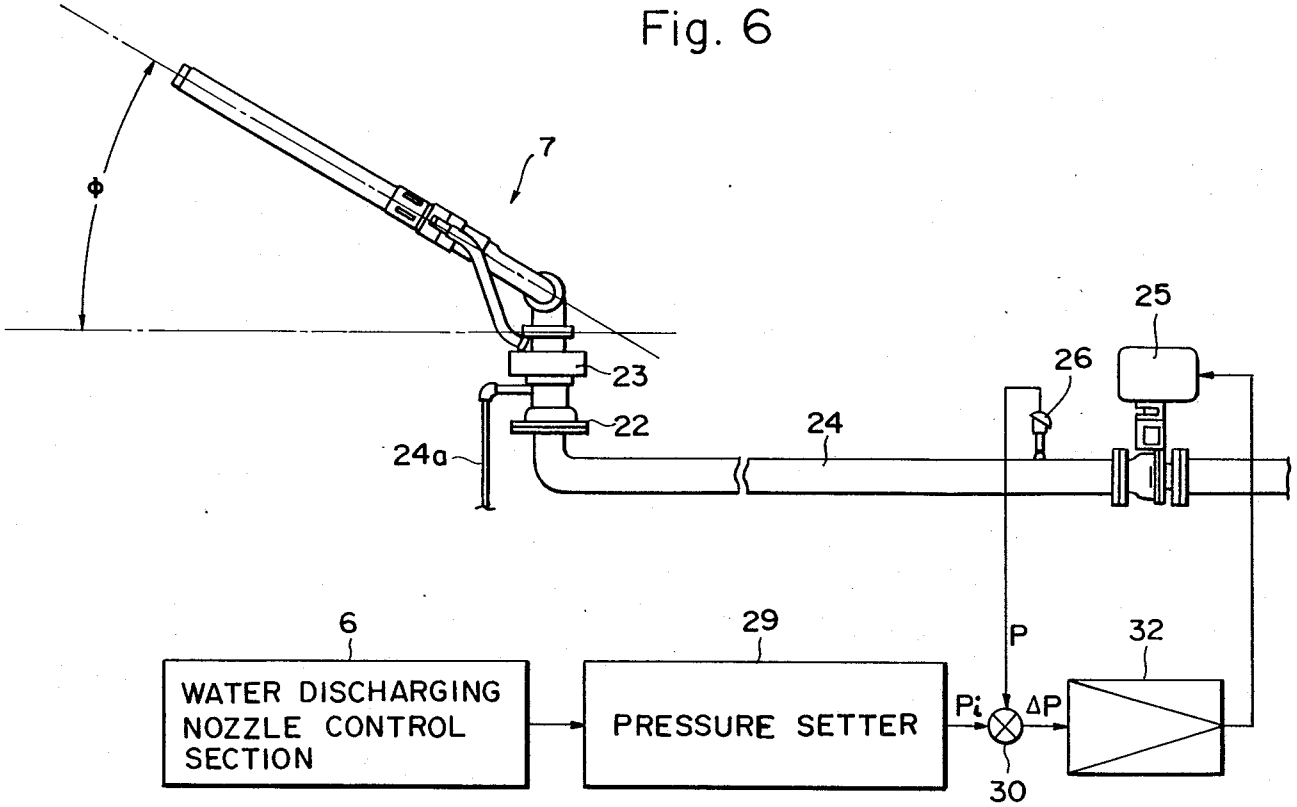
FIG. 6 is a block diagram which schematically shows water discharging nozzles and a system for controlling the horizontal reaches thereof.

FIG. 7 is an explanatory view showing water discharging patterns obtained by the water discharging pressure control of the nozzle 7 of FIG. 6 for a short distance L1, an intermediate distance L2 and a long distance L3. The portions encircled by solid lines in the respective patterns indicate water reach ranges and the shadowed portions in the respective encircled portions indicate effective water reach ranges in which a water sprinkling amount of 5 l/min $m^2$ which is a required water sprinkling amount for a sprinkler head in Japan. The angle $\phi$ of elevation is fixed about 25° at which the maximum horizontal reach is provided as described above and water discharged from the water discharging nozzle 7 pours gently from upper air onto a floor or the ground in any of the water discharging patterns for the short distance, intermediate distance and long distance. In contrast, water attacks strongly the ground or floor at an acute angle in the conventional water discharging nozzle or fire extinguishing hose.

A pressure corresponding to the water discharge for a short distance is supplied to the pressure setter 29 according to an instruction from the water discharging nozzle control section 6. The pressure setter 29 outputs a water discharging pressure P1 corresponding to the set distance L1 to the adder 30. The adder 30 outputs a deviation P from the then detected water discharging pressure P from the pressure sensor 6 to the current amplifier 22. The output from the current amplifier 22 controls the opening of the electrically driven valve 25, in a feedback manner, so that the water discharging pressure P from the pressure sensor 26 may be kept at the set pressure P1. As a result of this, the water discharging pressure P supplied to the water discharging nozzle 7 is maintained substantially constant, namely of the set pressure P1, and such a water discharging pattern suitable for the short distance L1 as shown in FIG. 7 is obtained.

Similar control operations for the water discharging pressure based on the setting of the horizontal reach are also carried out for the intermediate distance L2 and the long distance L3.

According to the results of the experiments conducted by the inventors, when the distance L1 is 42 m, the pressure to be set by the pressure setter 29 will be 3 $kgf/cm^2$. When the distance L2 is 65 m, the pressure P1 to be set by the pressure setter 29 will be 5 $kgf/cm^2$ and when the distance L3 is 90 m, the pressure to be set by the pressure setter 29 will be 8 $kgf/cm^2$.

The air pressure of the compressed air supplied to the water discharging nozzle 7 through the air piping **24*a*** is kept constant at 6.5 $kgf/cm^2$.

Although a common straight stream nozzle or foam nozzle may be employed in the present embodiment, the angle of elevation which provides a maximum horizontal reach is 30° to 40° for the former and is 20° for the latter.

Figure 8:
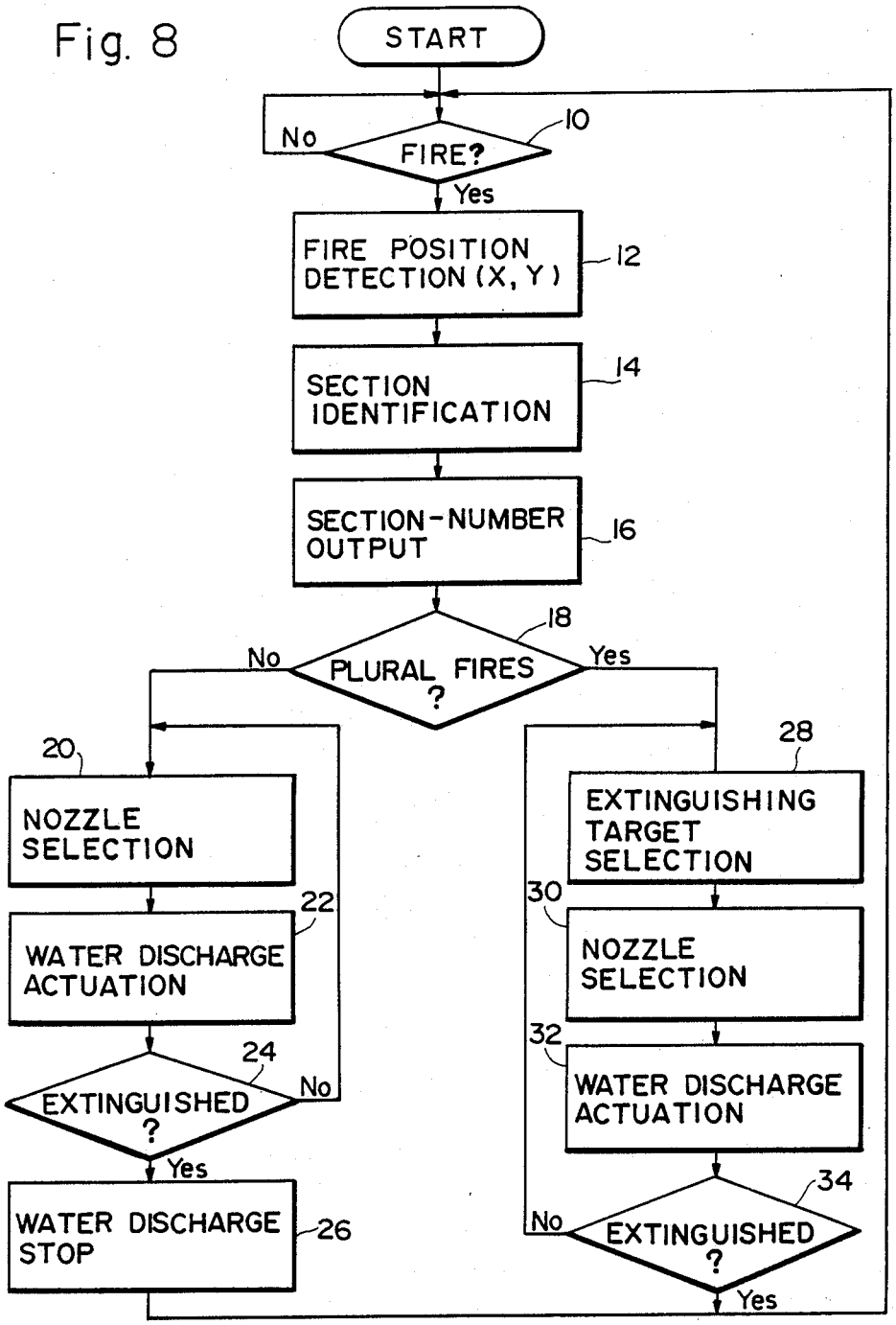
FIG. 8 is a flowchart for an extinguishing operation according to the embodiment of the present invention.

The fire supervising operation and fire extinguishing control operation of the present embodiment will now be described, while referring to the flowchart of FIG. 8.

At a normal time, the fire sensor **1*a* scans the supervisory region and it is determined at block 10 whether there is a fire or not. If a fire starts within the supervisory region and the fire sensor 1*a* detects the fire, the step proceeds to block 12. Then, a fire position co-ordinate (x, y) is calculated at the fire position detecting section 3 based on a fire position information ($\theta$, $\alpha$) output from the fire sensor 1*a***.

At next block 14, a section in the matrix pattern which corresponds to the fire position co-ordinate (xi, yi) calculated at block 12 is identified and a section number Mi corresponding to the fire position is output at block 16. Further a plurality of section number Mi . . . are output in case two or more fires are detected.

At next judging block 18, it is checked whether there is a plurality of fires or not. If there is a single fire, the step proceeds to block 20. Then, the water discharging nozzle control section 6 selects a water charging nozzle to be operated according to the nozzle selection information which is stored in the address Mi corresponding to the section number Mi indicative of the fire position output from the section-number identifying section 5. For example, if the water discharging nozzle **7*a* is selected, the corresponding selection data is read out to apply a selection instruction to the water discharging nozzle 7*a*. The water discharging nozzle control section 6 is also supplied with the fire position co-ordinate (xi, yi) from the fire position detecting section 3 in addition to the section number Mi from the section-number identifying section 5. Therefore, the water discharging nozzle control section 6 controls the selected water discharging nozzle 7*a*** in the horizontal direction to direct the fire position and set the water discharging pressure at a pressure corresponding to the preliminarily stored distance, simultaneously with the selection control based on the section number Mi.

Thus, the water discharging conditions are established for the selected water discharging nozzle **7*a*. Then, at block 22, the water discharging nozzle 7*a* is actuated. The actuation of the water discharging nozzle 7*a* is effected manually by an operator, or automatically, to start the discharge of an extinguishing liquid through the selected water discharging nozzle to the fire. It is checked at judging block 24 whether the fire has been extinguished or not. So long as the fire continues to be detected by the fire sensors 1*a*, 1*b*, the step returns to block 20 and 22 to continue the water discharge control based on the nozzle selection. Only after the detection of the fire has become extinct and the fire has been extinguished, the step proceeds to block 26** to stop the water discharge.

On the other hand, if it is determined at judging block 18 that a plurality of fires are at different places, the step proceeds to block 28 to read out the priority selection information by the address designation by the section numbers which have been output at block 16. The priority levels of the different fire positions for the fire extinguishing targets are compared with each other to select the fire position of the highest priority level as the first fire extinguishing target as indicated at block 28. Then, at block 30, a nozzle selection information is obtained on the basis of the section number which corresponds to the fire position selected as the fire extinguished target, thereby to select the water discharging nozzle based on the information. The water discharging nozzle is then turned horizontally according to the positional information of the fire selected as the fire extinguishing target, to the target and the water discharging distance or horizontal reach is then set.

Thereafter, the water discharging nozzle is actuated at block 32 and the extinguishing liquid is discharged from the selected water discharging nozzle to the fire determined as the first extinguishing target. At block 34, it is checked whether the fire of the first target has been extinguished or not. When the fire extinction has been confirmed, the step returns again to block 10 to repeat the operations as described above for the remaining fires.

The setting of the water discharging distance for the water discharging nozzle may alternatively be attained on the basis of the section number. More particularly, in the preliminary setting of the nozzle selection informations for assigning the nozzles 7*a* to 7*d* to the respective section numbers, the distances from the water discharging nozzles to be selected to the respective sections are preliminarily stored in the water discharging nozzle control section 6 as the water discharging distances or horizontal reaches.

As to the selection of the fire extinguishing target, a fire which is of lower priority level but of a larger scale may be selected, instead of the selection based on the priority order. Or, the section number M may be expressed as $M=f(\alpha, \theta)$ so that the section number may be directly identified from the output $(\alpha, \theta)$ from the fire sensor without effecting the co-ordinate conversion.

Of course, the present invention is not limited to the particulars of the embodiments as described above and any modification and change as claimed in the appended claims is included within the scope of the present invention.

We claim:

1. A fire supervising system which comprises: at least one fire sensor for detecting a fire starting within a supervisory region to output a positional information of the detected fire;

at least one water discharging nozzle for discharging water into the supervisory region;

a section setting means for dividing the supervisory region into a matrix pattern to set a plurality of sections and for allotting section numbers to the respective sections;

a section identifying means which is input with the fire position information from the fire sensor to identify the section corresponding to said position information; and output the section number of the identified sections;

a nozzle control means for selecting the section in which a fire is to be extinguished and for driving the water discharging nozzle on the basis of a section number from the section identifying means and a priority order of the respective section numbers which is set up in advance; and wherein water discharging distances of said at least one water discharging nozzle to the respective sections are set in said nozzle control means, and said at least one water discharging nozzle is controlled to vary its horizontal reach according to the section where a fire is to be extinguished.

2. A fire supervising system as claimed in claim 1, in which said nozzle control means further selects the water discharging target of the water discharging nozzle based on the water nozzle assignment which is set for the respective sections, thereby to control the driving of the nozzle.

3. A fire supervising system as claimed in claim 2, in which water discharging distances of the water discharging nozzle to the respective sections are set in said nozzle control means and said water discharging nozzle is controlled to vary its horizontal reaches according to the sections.

4. A fire supervising system as claimed in claim 3, in which said water discharging nozzle includes a water supply piping, said water supply piping having an electrically driven valve for varying a water supply amount and said water discharging nozzle is fixed with respect to its angle of elevation so that the water discharging distance is determined by the degree of opening of said electrically driven valve.

5. A fire supervising system as claimed in claim 4, in which said positional information output from the fire sensor is also input to said nozzle control means and said nozzle control means changes the direction of said water discharging nozzle according to the input positional information.

6. A fire supervising system as claimed in claim 4, in which said nozzle control means changes the direction of said water discharging nozzle according to angular data which are set in advance for the sections to be water discharging targets.

7. A fire supervising system which comprises: at least one fire sensor for detecting a fire starting within a supervisory region to output positional information of the detected fire;

a plurality of water discharging nozzles for discharging water into the supervisory region;

a section setting means for dividing the supervisory region into a matrix pattern to set a plurality of sections and for allotting section numbers to the respective sections;

a section identifying means which is input with the fire position information from the fire sensor to identify the section corresponding to said position information and output the section number of the identified section; and a nozzle control means for selecting and driving one of the water discharging nozzles in charge. On the basis of a section number from the section identifying means and water discharging nozzle selection data of the respective section numbers which is set up in advance.

8. A fire supervising system as claimed in claim 7, in which said nozzle control means further selects the water discharging target of the water discharging nozzle based on the water nozzle assignment which is set for the respective sections, thereby to control the driving of the nozzle.

9. A fire supervising system as claimed in claim 8, in which water discharging distances of the water discharging nozzle to the respective sections are set in said nozzle control means and said water discharging nozzle is controlled to vary it horizontal reaches according to the sections.

10. A fire supervising system as claimed in claim 9, in which said water discharging nozzle includes a water supply piping, said water supply piping having an electrically driven valve for varying a water supply amount and said water discharging nozzle is fixed with respect to its angle of elevation so that the water discharging distance is determined by the degree of opening of said electrically driven valve.

11. A fire supervising system as claimed in claim 10, in which said positional information output from the fire sensor is also input to said nozzle control means and said nozzle control means changes the direction of said water discharging nozzle according to the input positional information.

12. A fire supervising system as claimed in claim 11, in which said nozzle control means changes the direction of said water discharging nozzle according to angular data which are set in advance for the sections to be water discharging targets.

13. A method for determining a fire extinguishing target, comprising: dividing a fire supervisory region into a matrix pattern to set a plurality of sections and alloting section numbers to the respective sections; identifying the section containing a fire from the positional information of the fire starting in one or more of said sections within the supervisory region which has been output from a fire sensor, and outputting the section number of the identified section; and selecting and driving at least one water discharging nozzle based on a section number which is identified as a water discharging target and based on a priority order set up in advance for said plurality of sections; and wherein the at least one water discharging nozzle has a horizontal reach set for each said plurality of sections, and said at least one water discharging nozzle is adapted to change its horizontal reach according to the section which is the water discharging target.

14. A method for determining a fire extinguishing target as claimed in claim 13, in which at least one of said plurality of water discharging nozzles charged to discharge water is actuated so as extinguish the fire.

15. A method for determining a fire as claimed in claim 13, reaches of the water discharging nozzle are set for the respective sections and said water discharging nozzle is adapted to change its horizontal reaches according to the section to be the water discharging target, and wherein reach of the discharge water is further a function of the water discharging pressure.

* * * * *

UNITED STATES PATENT AND TRADEMARK OFFICE

CERTIFICATE OF CORRECTION

PATENT NO. : 4,909,329
DATED : March 20, 1990
INVENTOR(S) : Yoshida et al.

It is certified that error appears in the above-identified patent and that said Letters Patent is hereby corrected as shown below:

Title page,
Item [73], after the words Kabushiki Kaisha, change the word "Kockiki" to -- Hochiki --.

Signed and Sealed this

Twenty-first Day of May, 2002

*Attest:*

*Attesting Officer*

JAMES E. ROGAN
*Director of the United States Patent and Trademark Office*